US009111514B2

(12) United States Patent
Fukada

(10) Patent No.: US 9,111,514 B2
(45) Date of Patent: Aug. 18, 2015

(54) DELAYED REGISTRATION DATA READOUT IN ELECTRONIC MUSIC APPARATUS

(71) Applicant: Yamaha Corporation, Hamamatsu-Shi, Shizuoka-Ken (JP)

(72) Inventor: Atsushi Fukada, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/078,007

(22) Filed: Nov. 12, 2013

(65) Prior Publication Data

US 2014/0130655 A1 May 15, 2014

(30) Foreign Application Priority Data

Nov. 13, 2012 (JP) ..... 2012-249268

(51) Int. Cl.

| | |
|---|---|
| ***G10H 7/00*** | (2006.01) |
| ***G10H 1/00*** | (2006.01) |
| ***G10H 1/24*** | (2006.01) |
| ***G10K 15/02*** | (2006.01) |

(52) U.S. Cl.

CPC ..... *G10H 7/00* (2013.01); *G10H 1/0058* (2013.01); *G10H 1/24* (2013.01); *G10K 15/02* (2013.01); *G10H 2240/005* (2013.01); *G10H 2240/011* (2013.01); *G10H 2240/325* (2013.01)

(58) Field of Classification Search

USPC ..... 84/622–633, 659–665
IPC ..... G10H 2240/005,2240/011, 7/00
See application file for complete search history.

(56) References Cited

U.S. PATENT DOCUMENTS

| | | | | | |
|---|---|---|---|---|---|
| 4,515,056 | A | * | 5/1985 | Kashio | 84/604 |
| 4,554,855 | A | * | 11/1985 | Alonso et al. | 84/625 |
| 4,590,838 | A | * | 5/1986 | Kashio | 84/631 |
| 4,915,007 | A | * | 4/1990 | Wachi et al. | 84/622 |
| 5,044,251 | A | * | 9/1991 | Matsuda et al. | 84/615 |

(Continued)

FOREIGN PATENT DOCUMENTS

| | | | |
|---|---|---|---|
| JP | 11-224086 | A | 8/1999 |
| JP | 2005-062766 | A | 3/2005 |

OTHER PUBLICATIONS

Anynemous. (Dec. 16, 2002). "Standard MIDI Files," The Sonic Spot, located at: <URL:http://web.archive.org/web/20021216092723/http://www.sonicspot.com/guide/midifiles.html>, retrieved on Mar. 12, 2010, the whole document, ten pages.

(Continued)

*Primary Examiner* — David Warren
(74) *Attorney, Agent, or Firm* — Morrison & Foerster LLP

(57) ABSTRACT

A storage stores at least one set of registration data comprising a plurality of tone setting parameters. An instruction section instructs readout of the registration data set from the storage. A controller makes a setting such that the parameters in the registration data set are used in response to an instruction for reading out the registration data set, and makes a setting such that at least one or some of the tone setting parameters in the one set of registration data are used at delayed readout timing later than a time point at which the instruction has been issued. Thus, two or more sub-sets of the parameters in the registration data set can be set to be used at mutually different timing. Namely, a sub-set of the parameters can be set to be used at delayed readout timing later than a time at which a readout instruction has been issued.

14 Claims, 5 Drawing Sheets

(56) References Cited

U.S. PATENT DOCUMENTS

| | | | | |
|---|---|---|---|---|
| 5,177,314 | A * | 1/1993 | Matsuda et al. | 84/615 |
| 5,347,087 | A * | 9/1994 | Kozuki | 84/605 |
| 5,367,120 | A * | 11/1994 | Hoshiai | 84/654 |
| 5,376,753 | A * | 12/1994 | Kosugi et al. | 84/658 |
| 5,689,571 | A * | 11/1997 | Kitamura | 381/63 |
| 5,896,291 | A * | 4/1999 | Hewitt et al. | 700/94 |
| 6,031,175 | A | 2/2000 | Tozuka | |
| 6,878,869 | B2 * | 4/2005 | Mita et al. | 84/609 |
| RE41,757 | E * | 9/2010 | Isozaki et al. | 84/603 |
| 8,051,376 | B2 * | 11/2011 | Adhikari et al. | 715/727 |
| 8,611,557 | B2 * | 12/2013 | Oxford et al. | 381/98 |
| 2002/0029683 | A1 * | 3/2002 | Tamura | 84/603 |
| 2002/0117045 | A1 * | 8/2002 | Mita et al. | 84/609 |
| 2002/0166441 | A1 * | 11/2002 | Washiyama et al. | 84/662 |
| 2003/0091204 | A1 * | 5/2003 | Gibson | 381/119 |
| 2004/0099129 | A1 * | 5/2004 | Ludwig | 84/663 |
| 2004/0240686 | A1 * | 12/2004 | Gibson | 381/119 |
| 2006/0085198 | A1 * | 4/2006 | Kayama et al. | 704/267 |
| 2006/0090632 | A1 * | 5/2006 | Ludwig | 84/645 |
| 2006/0156909 | A1 * | 7/2006 | Kobayashi | 84/645 |
| 2006/0185504 | A1 * | 8/2006 | Kobayashi | 84/645 |
| 2009/0046871 | A1 * | 2/2009 | Oxford et al. | 381/98 |
| 2009/0056527 | A1 * | 3/2009 | Yamabata et al. | 84/624 |
| 2013/0239786 | A1 * | 9/2013 | Sakata | 84/626 |
| 2014/0088958 | A1 * | 3/2014 | Chen | 704/214 |
| 2014/0088968 | A1 * | 3/2014 | Chen | 704/254 |
| 2014/0105409 | A1 * | 4/2014 | Oxford et al. | 381/63 |
| 2014/0130655 | A1 * | 5/2014 | Fukada | 84/622 |
| 2014/0142946 | A1 * | 5/2014 | Chen | 704/266 |

OTHER PUBLICATIONS

Apple Computer, Inc. (2004). Logic Studio Pro 7, Reference Manual, Retrieved from Internet: URL:http://manuals.info.apple.com/en/LogicPro7_ReferenceManual.pdf Retrieved on Mar. 17, 2009, 72 pages.

Extended European Search Report mailed Feb. 28, 2014, for EP Application No. 13192420.1, nine pages.

* cited by examiner

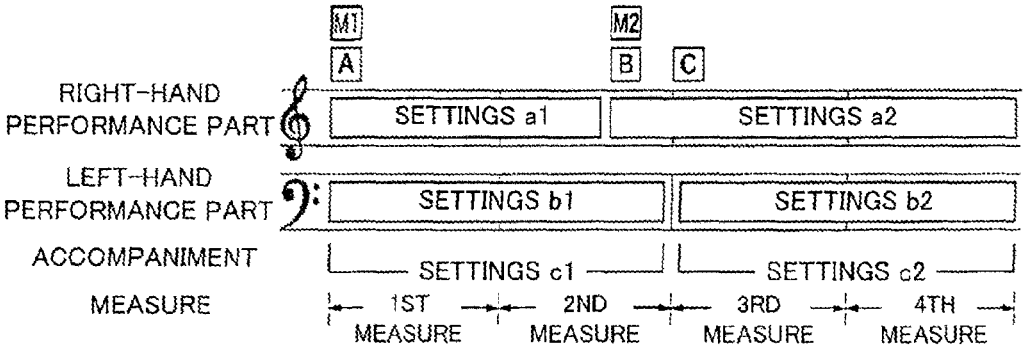

FIG. 3A

| REGISTRATION | A | B | C |
|---|---|---|---|
| | PARAMETER | PARAMETER | PARAMETER |
| RIGHT-HAND PERFORMANCE PART | SETTINGS a1 | SETTINGS a2 | SETTINGS a2 |
| LEFT-HAND PERFORMANCE PART | SETTINGS b1 | SETTINGS b1 | SETTINGS b2 |
| ACCOMPANEMENT | SETTINGS c1 | SETTINGS c1 | SETTINGS c2 |

( PRIOR ART )

FIG. 3B

| REGISTRATION | M1 | | M2 | |
|---|---|---|---|---|
| | PARAMETER | READOUT SETTING | PARAMETER | READOUT SETTING |
| RIGHT-HAND PERFORMANCE PART | SETTINGS a1 | NORMAL | SETTINGS a2 | NORMAL |
| LEFT-HAND PERFORMANCE PART | SETTINGS b1 | NORMAL | SETTINGS b2 | RESERVATION #1 |
| ACCOMPANEMENT | SETTINGS c1 | NORMAL | SETTINGS c2 | RESERVATION #1 |

FIG. 3C

| READOUT SETTING | SET TIMING |
|---|---|
| NORMAL | PROMPTLY SET IN RESPONSE TO READOUT OPERATION |
| RESERVATION #1 | SET AT THE BEGINNING OF A MEASURE IMMEDIATELY FOLLOWING READOUT OPERATION |
| RESERVATION #2 | SET AT A BEAT IMMEDIATELY FOLLOWING READOUT OPERATION |
| : | : |
| OFF | NOT SET |

FIG. 3D

| REGISTRATION | M1 | | M2' | |
|---|---|---|---|---|
| | PARAMETER | READOUT SETTING | PARAMETER | READOUT SETTING |
| RIGHT-HAND PERFORMANCE PART | SETTINGS a1 | NORMAL | SETTINGS a2 | RESERVATION #2 |
| LEFT-HAND PERFORMANCE PART | SETTINGS b1 | NORMAL | SETTINGS b2 | RESERVATION #1 |
| ACCOMPANEMENT | SETTINGS c1 | NORMAL | SETTINGS c2 | RESERVATION #1 |

DELAYED REGISTRATION DATA READOUT IN ELECTRONIC MUSIC APPARATUS

BACKGROUND

The present invention relates to a technique for delayed registration data readout (or recall) in an electronic music apparatus and more particularly to an electronic music apparatus employing a novel delayed registration data readout (or recall) technique. The present invention also relates to a method for reading out registration data from a storage device in accordance with the delayed registration data readout technique, and a computer program for implementing the method or a non-transitory storage medium storing such a program.

A set of "registration data" (or registration data set) comprises settings of a plurality of parameters, such as a tone color and an accompaniment style, (hereinafter referred to as "parameter settings") that are handled as a set of data. Heretofore, electronic music apparatus have been known, in which a plurality of such sets of registration data are prepared and stored in a memory in advance (e.g., prior to a music performance), and in which, during the performance, any desired set of registration data is read out and set at desired timing so as to simultaneously switch previous parameter settings to a tone color, accompaniment style, etc. included in the desired set of registration data.

A performance apparatus employing such an electronic music apparatus is known, in which, once readout (or recall) of a given set of registration data is instructed, only one or some of the parameter settings, not all of the parameter settings, included in the given set of registration data are read out (or recalled) and set into the apparatus (see, for example, Japanese Patent Application Laid-open Publication No. HEI-11-224086 that corresponds to U.S. Pat. No. 6,031,175). In this conventionally-known performance apparatus, once readout of a set of registration data including a first parameter not related to an automatic accompaniment and a second parameter related to an automatic accompaniment is instructed, only the first parameter is read out and set into the apparatus.

However; with the aforementioned conventionally-known performance apparatus, even when only one or some parameters are to be read out, it is necessary to read out the entire of a set of registration data, requiring one separate readout operation per parameter use timing. Therefore, with the conventionally-known performance apparatus, different types of parameters to be used at different timing have to be prepared as different sets of registration data. Thus, the conventionally-known performance apparatus would necessitate increased user's time and labor, increased consumption of memory capacity due to such redundant registration data and increased number of user's operations for reading out the registration data.

SUMMARY OF THE INVENTION

In view of the foregoing prior art problems, it is an object of the present invention to provide an improved technique for delayed registration data readout, which allows at least one or some of parameters included in a desired set of registration data to be set at delayed timing while effectively minimizing increase in memory capacity consumption and user's time and labor including the number of user's registration-data readout operations.

Note that, in this specification, the term "tone" is used herein to embrace various types of sounds.

In order to accomplish the above-mentioned object, the present invention provides an improved electronic music apparatus, which comprises: a storage section storing at least one set of registration data comprising a plurality of tone setting parameters; an instruction section configured to instruct readout (or recall) of the one set of registration data from the storage section; and a control section configured to make a setting such that the parameters in the one set of registration data are used in response to an instruction issued by the instruction section for reading out the one set of registration data, the control section making the setting such that at least one or some of the plurality of tone setting parameters in the one set of registration data are used at delayed readout timing later than a time point at which the instruction has been issued.

According to the present invention, when readout of a set of registration data has been instructed, a setting is made such that at least one or some of the plurality of tone setting parameters in the set of registration data are used at delayed readout timing later than a time point at which the instruction has been issued, rather than all of the parameters being used at that time point. Thus, in response to a single readout instruction, two or more sub-sets of the parameters in the set of registration data can be set to be used at mutually different timing. For example, whereas a first sub-set of the parameters can be set to be used at the time point at which the readout instruction has been issued, a second sub-set of the parameters can be set to be used at delayed readout timing later than that time point.

In this way, different types of parameters to be used at mutually different timing can be included in a single set of registration data Namely, there is no need to construct different types of parameters to be used at mutually different timing as different or separate sets of registration data as done in the past, and thus, the number of sets of registration data to be used can be reduced. As a result, the present invention can minimize increase in memory capacity consumption and user's time and labor necessary for creating registration data. Further, in response to only a single registration-data readout instructing operation, a plurality of sub-sets of different types of parameters in the instructed set of registration data can be set to be used at a plurality of different timing; thus, the present invention can also reduce the number of user's registration-data readout instructing operations. In the aforementioned manner, the present invention can make a setting such that one or some of parameters included in one set of registration data are used at different timing from the other parameters in the set of registration data, while minimizing increase in the memory capacity consumption and user's time and labor including the number of user's registration-data readout instructing operations.

As an example, the delayed readout timing defines a start or end position of a measure or a beat position in music later than the time point at which the instruction has been issued. Thus, when a registration-data readout instruction for reading out one set of registration data has been issued in the middle of a given measure, for example, a setting can be made such that, of the instructed one set of registration data, a parameter that would present inconvenience if used (or if switching is made to that parameter) in the middle of the given measure is used (or switching is made to that parameter) at a start position of a measure immediately following the given measure or the readout instruction.

According to another aspect of the present invention, there is provided a storage device, which comprises: a first storage section storing a plurality of sets of registration data each comprising a plurality of tone setting parameters, any one of the sets of registration data being capable of being read out from the first storage section in response to a readout instruction; and a second storage section storing delayed readout timing data in association with individual ones of the sets of registration data, the delayed readout timing data defining the delayed readout timing such that, in response to an instruction for reading out one of the sets of registration data, at least one or some of the plurality of tone setting parameters in the one of the sets of registration data are used at the delayed readout timing later than a time point at which the instruction has been issued. This storage device is usable as the storage section of the aforementioned electronic music apparatus of the present invention.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 3A to 3D are diagrams showing example settings made by the registration data sets;

DETAILED DESCRIPTION

Figure 1:
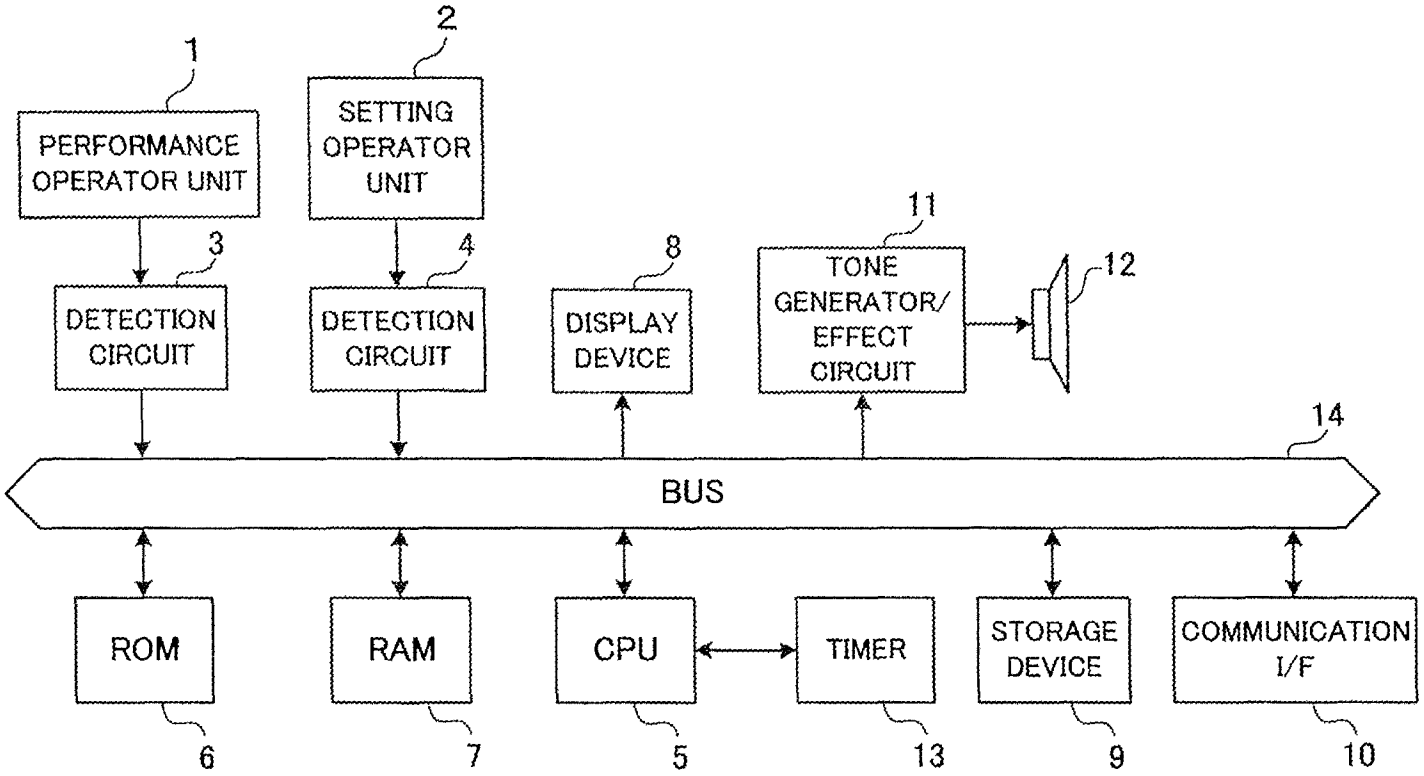
FIG. 1 is a block diagram showing an overall construction of a preferred embodiment of an electronic music apparatus of the present invention.

FIG. 1 is a block diagram showing an overall construction of a preferred embodiment of an electronic music apparatus of the present invention. As shown in FIG. 1, the embodiment of the electronic music apparatus includes: a performance operator unit 1 including a keyboard for inputting performance data including tone (sound) pitch information; a setting operator unit 2 including a plurality of switches for inputting various information; a detection circuit 3 for detecting an operating state of the performance operator unit 1; a detection circuit 4 for detecting an operating state of the setting operator unit 2; a CPU 5 for controlling overall behavior of the electronic music apparatus; a ROM 6 storing therein control programs for execution by the CPU 5, various table data, various parameters, etc.; and a RAM 7 for temporarily storing various input information, results of arithmetic operations, etc. The embodiment of the electronic music apparatus further includes: a display device 8 including a small-size liquid crystal display (LCD), light-emitting diodes (LEDs) etc.; a storage device 9 storing various application programs including the control programs, various music piece data, various other data, etc.; a communication interface (I/F) 10 for connecting not-shown external equipment to the electronic music apparatus and communicating data between the electronic music apparatus and the external equipment; a tone generator/effect circuit 11 for converting, into tone signals, performance data input via the performance operator unit 1, performance data obtained by reproducing any of music piece data stored in the storage device 9 and the like, but also imparting various effects to the tone signals; a sound system 12 including a DAC (Digital-to-Analog Converter), amplifier, speaker etc. for converting tone signals given from the tone generator/effect circuit 11 into audible sounds; and a timer 13 for counting various interrupt times in timer-interrupt processing and counting various time intervals.

The aforementioned components 3 to 11 of the electronic music apparatus are interconnected via a bus 14, the timer 13 is connected to the CPU 5, and the sound system 12 is connected to the tone generator/effect circuit 11.

The storage device 9 comprises one or more of storage media, such as a flexible disk (FD), hard disk (HD), CD-ROM, DVD (Digital Versatile Disk), opto-magnetic disk (MO), semiconductor memory and the like, and a drive for driving the storage media. The storage media may be detachably attachable to the drive, or the storage device 9 itself may be detachably attachable to the electronic music apparatus. Alternatively, neither the storage media nor the storage device 9 may be undetachable. The control programs for execution by the CPU 5 too can be stored in the storage device 9 as noted above. Where a particular control program is not prestored in the ROM 6, the control program may be stored in the storage device 9, so that, by reading the control program from the storage device 9 into the RAM 7, the CPU 5 is allowed to operate in exactly the same way as in the case where the particular control program is stored in the ROM 6. This arrangement greatly facilitates version upgrade of the control program, addition of a new control program, etc.

The communication network I/F 10 may be, for example, a music-oriented wired I/F dedicated to communicating (receiving and transmitting) music signals, such as MIDI (Musical Instrument Digital Interface) signals, a general-purpose short-distance wired I/F, such as USB or IEEE1394, a general-purpose network I/F, such as Ethernet (registered trademark), or a general-purpose short-distance wireless I/F, such as a wireless LAN (Local Area Network) or Bluetooth (registered trademark). Although it is assumed that the preferred embodiment employs the USB as the communication I/F 10, any other desired type of I/F may be used in place of or in addition to the USB.

Whereas the preferred embodiment of the electronic music apparatus is constructed in an electronic keyboard instrument as seen from the forgoing, it may alternatively be constructed in a general-purpose personal computer having a keyboard externally connected thereto. Further, because the present invention can be implemented without a keyboard being provided as its essential element, the electronic music apparatus may be constructed as another desired type of musical instrument, such as a sting instrument, wind instrument, percussion instrument or the like. Further, the basic principles of the present invention may be applied to various electronic equipment, such as karaoke equipment, game equipment, communication equipment or the like, which has a music reproduction function or tone signal processing function, without the application of the present invention being limited to electronic musical instruments alone. In this case, electronic equipment having a delayed registration data readout function of the present invention corresponds to the electronic music apparatus of the present invention.

Figure 2:
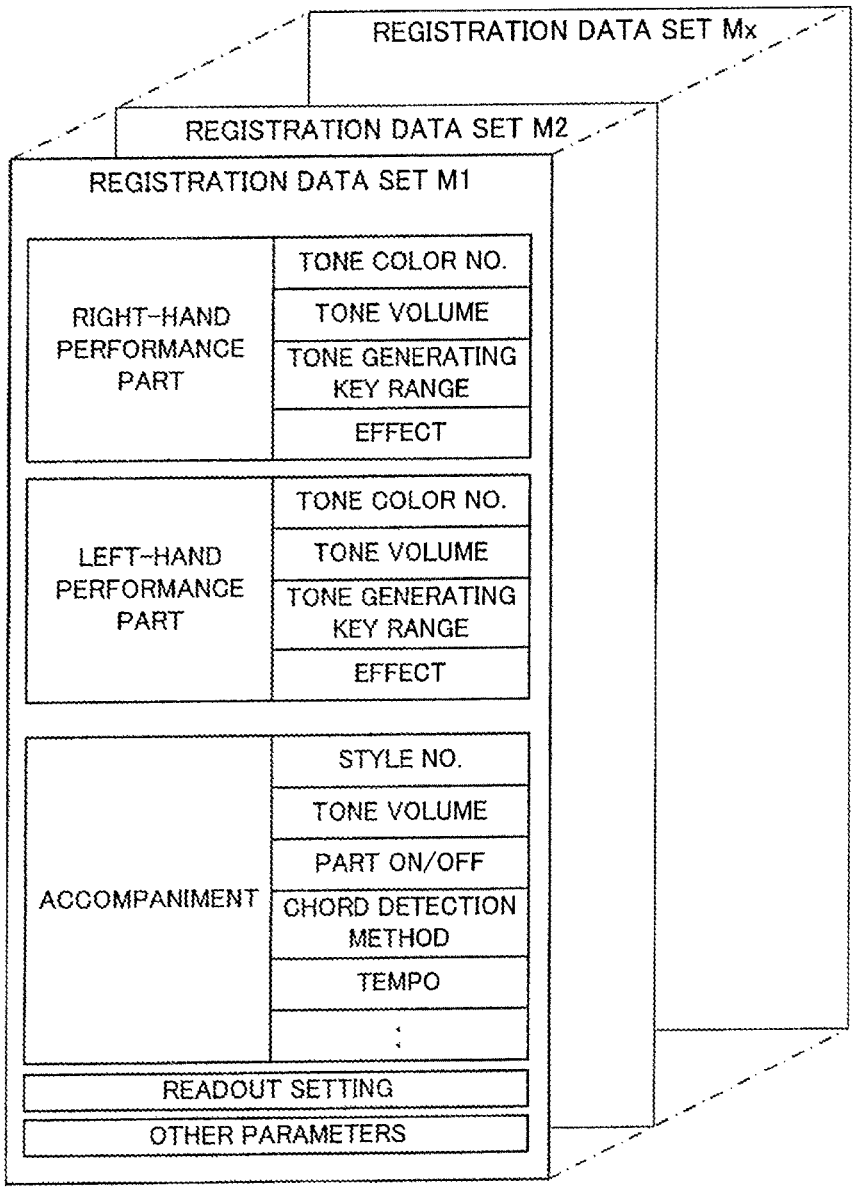
FIG. 2 is a diagram showing an example data format of registration data sets handled in the embodiment of the electronic music apparatus.

FIG. 2 is a diagram showing an example data format of registration data handled in the instant embodiment. Each set of registration data (registration data set) comprises a plurality of tone setting parameters. More specifically, as noted previously, each set of registration data (registration data set) comprises a plurality of parameter settings, such as a tone color and an accompaniment style, that are handled as a set of data. Normally, registration data are created in advance by a user and stored into a registration memory.

The registration memory includes a plurality of registration areas for storing a plurality of sets of registration data. Although it is assumed here that the registration memory in the instant embodiment includes eight registration areas for storing eight sets of registration data, the number of the registration areas is of course not limited to "eight". The registration areas are assigned consecutive numbers "1" to "8", and these numbers assigned to the registration areas are associated with numbers assigned to eight switches ("registration readout switches"), operable by the user for instructing readout or recall of the registration data sets stored in the registration areas. The registration readout switches belong to the above-mentioned setting operator unit 2.

In FIG. 2, x ("x" is an integral number in the range of 1-8) sets of registration data (or registration data sets) are shown. As an example, the registration data set M1 comprises parameter settings (such as tone color numbers, tone volumes, tone generating key ranges and effects) related to a right-hand performance part and a left-hand performance part, parameter settings (such as a style number, tone volume, performance part ON/OFF, chord detection method and tempo) related to an accompaniment, and other parameter settings. Namely, the registration data set M1 is the result of the user first selecting the above-mentioned types of parameters, setting values of the selected parameters and then storing the thus-set parameter values (parameter settings) into the registration area of the registration memory 1 assigned number "1". Namely, the user can register, as registration data, any types of parameters (other than those in the illustrated example of FIG. 2) as long as the parameters are selectable parameters. In the illustrated example of FIG. 2, the plurality of parameters in the registration data set M1 are classified into three sub-sets (i.e., right-hand performance part, left-hand performance part and accompaniment).

Because the main characteristic feature of the present invention resides in usage of various parameter settings registered as registration data, not in the content of the individual parameters, explanation about the content of the individual parameters and illustration of specific examples of parameter settings stored as the other registration data sets M2 to Mx is omitted here.

The present invention is characterized by storing data related to "readout setting" in association with a registration data set, in addition to the aforementioned known construction of registration data sets. As will be detailed later, "delayed readout timing data" is stored as "readout setting" information in the instant embodiment of the present invention. The "delayed readout timing data" is data which defines delayed readout timing such that, in response to an instruction for reading out a registration data set, at least one or some of the parameters in the registration data set are used at the "delayed readout timing" later than a time point at which the instruction has been issued.

In the illustrated example of FIG. 2, registration data of the known construction in a registration data set and "readout setting" information (i.e., delayed readout timing data) corresponding the registration data are stored together in one registration area of the registration memory. However, the registration data and the "readout setting" information may be stored separately from each other. Each set of registration data comprising a plurality of tone setting parameters is stored in a first storage section, while the corresponding "readout setting" information (i.e., delayed readout timing data) is stored in a second storage section.

Any necessary one of the registration data sets M1 to Mx stored in the respective registration areas is read out (recalled) and used at necessary timing during a performance (automatic accompaniment in the instant embodiment). For example, in response to the user depressing the registration readout switch assigned "No. 1", all of the parameter settings of the registration data set M1 stored in the registration area assigned "No. 1" are read out and temporarily stored into a current area (not shown) provided in a predetermined location of the RAM 7. At what timing the individual parameter settings of the registration data set M1 stored in the current area are used (set) will be described later.

Let it be assumed here that the registration memory in the instant embodiment is provided in a part of the RAM 7. Because it is preferable that the stored content of the registration memory be not erased even when the power to the embodiment of the electronic music apparatus is turned off, the instant embodiment uses a power-backed-up RAM as the RAM 7. Of course, the registration memory may be provided in a non-volatile memory separate from the RAM 7, such as a flash memory, or the RAM 7 itself may be implemented by a flash memory. As another alternative, the registration memory may be provided in the storage device 9.

Figure 4:
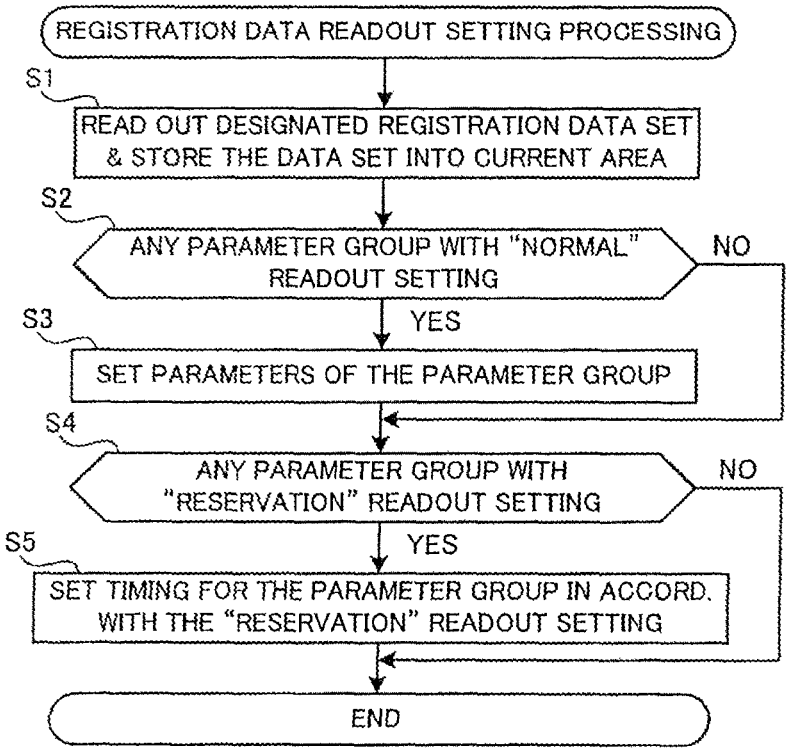
FIG. 4 is a flow chart showing an example operational sequence of registration data readout setting processing performed in the embodiment of the electronic music apparatus.
Figure 5:
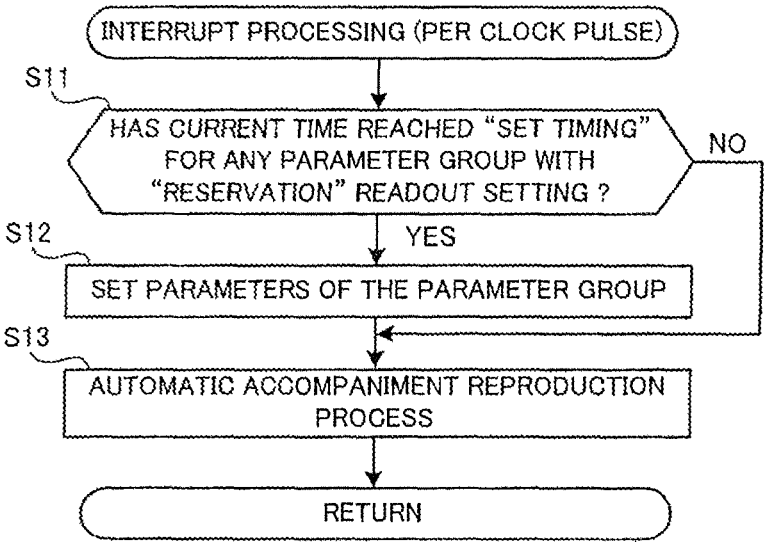
FIG. 5 is a flow chart showing an example operational sequence of interrupt processing performed in the embodiment of the electronic music apparatus.

The following paragraphs first discuss, with reference to FIG. 3, an outline of control processing executed by the electronic music apparatus constructed in the aforementioned manner, and then discuss details of the control processing with reference to FIGS. 4 and 5.

FIG. 3 is a diagram showing example settings made by registration data sets; more specifically, FIG. 3 shows an example where parameter setting is performed by a conventionally-known electronic music apparatus and an example where parameter setting is performed by the preferred embodiment of the electronic music apparatus. More specifically, FIG. 3A shows transition of settings of parameters to be made by the user for the right-hand performance part, right-hand performance part and accompaniment of a given music piece.

Let it also be assumed that, in both the case where the conventionally-known electronic music apparatus is employed and the case where the preferred embodiment of the electronic music apparatus is employed, the user can select and reproduce automatic accompaniment data and execute a performance using a keyboard to such an automatic accompaniment. Note that selection of the automatic accompaniment data is made on the basis of the content of the registration data (in the embodiment of the electronic music apparatus, accompaniment-related parameter settings of the registration data set M1 of FIG. 2). Thus, the user starts an automatic accompaniment after having selected and set the registration data.

Because the automatic accompaniment data are being reproduced during the performance in the instant embodiment, a current performance position can be constantly known by the CPU 5. Further, the current performance position is displayed on the display device 8 by the CPU 5, and thus, the user too can know the current performance position.

FIG. 3B shows settings of registration data sets A to C to be used in making the parameter settings of FIG. 3A by means of the conventionally-known electronic music apparatus, and FIG. 3C shows settings of registration data M1 and M2 to be used in making the parameter settings of FIG. 3A by means of the embodiment of the electronic music apparatus. Further, FIG. 3D shows meanings of various information registered as "readout setting" in the registration data M1 and M2.

In a case where parameter settings of the right-hand performance part, left-hand performance part and accompaniment are to be caused to transition by switching as shown in FIG. 3A, the user first creates the registration data sets A to C of FIG. 3B and stores the created registration data sets A to C into the registration memory prior to a performance. For example, in a case where the registration data sets A to C are stored in the registration areas assigned "No. 1" to "No. 3", respectively, and if the user reads out and sets the registration data set A, the user depresses the registration readout switch assigned "No. 1" at timing when the registration data set A should be set.

When a performance is to be started, the user first depresses the registration readout switch of No. 1. Thus, the registration data set A is read out (recalled) and promptly set, so that the right-hand performance part, left-hand performance part and accompaniment are set at "settings 1", "settings b1" and "settings c1", respectively, in a first measure in FIG. 3A. In FIG. 3A, time points at which the individual registration readout switches are depressed are each indicated by a "□" mark with the name of the corresponding registration data put in it.

Then, the user instructs a start of an automatic accompaniment in order to start the performance. Thus, reproduction of automatic accompaniment data selected in aforementioned "settings c1" is started with a tone volume, tempo, etc. set in "settings c1", and the performance is started with the first measure.

As the performance progresses to reach a point immediately before a third beat of a second measure, the user depresses the registration readout switch of No. 2. Thus, the registration data set B is read out and promptly set, so that the parameter settings for the right-hand performance part, left-hand performance part and accompaniment transition or switch to "settings a2", "settings b1" and "settings c1" at the third beat of the second measure as shown in FIG. 3A.

As the performance further progresses to reach a point immediately before a third measure, the user depresses the registration readout switch of No. 3. Thus, the registration data set C is read out and promptly set, so that the parameter settings for the right-hand performance part, left-hand performance part and accompaniment switch to "setting a2", "setting b2" and "setting c2" in the third measure as shown in FIG. 3A.

Namely, the parameter settings for the right-hand performance part, left-hand performance part and accompaniment of FIG. 3A ultimately change or switch from "settings a1", "settings b1" and "settings c1" to "settings a2", "settings b2" and "settings c2" in the third and subsequent measures. However, such switching to the ultimate settings is not executed at the same timing for all of the right-hand performance part, left-hand performance part and accompaniment, but executed at timing differing among the right-hand performance part, left-hand performance part and accompaniment; however, in the illustrated example, the switching to the ultimate settings is executed at the same timing for the left-hand performance part and the accompaniment. Even for such switching of the settings, the conventionally-known electronic music apparatus requires one separate registration data set B to be created and stored. Namely, the conventionally-known electronic music apparatus requires the user to take the trouble of creating the registration data set B and requires increase in the storage capacity of the registration memory for storing the registration data set B. In addition, because the user has to depress the registration readout switches of No. 2 and No. 3, the necessary number of user's operations would increase.

To avoid such inconveniences, the instant embodiment of the electronic music apparatus is constructed as follows. Namely, data (a type of parameter) called "readout settings" are defined and included in respective parameter groups of the right-hand performance part, left-hand performance part and accompaniment as shown in FIG. 3C. Then, once a given registration data set is read out to the current area in response to a user's readout instruction, individual parameter settings (except for the "readout settings") included in the parameter groups of the right-hand performance part, left-hand performance part and accompaniment are read out at timing corresponding to the respective "readout settings" and set into corresponding registers.

FIG. 3D shows main information registered as the "readout setting" and set timing of the readout setting. Namely, in FIG. 3D, readout setting "Normal" represents "promptly set in response to a readout operation"; "Reservation #1" represents "set at the beginning of a measure immediately following a readout operation"; "Reservation #2" represents "set at a beat immediately following a readout operation"; and "Off" represents "not set".

Note that omission mark ":" inserted between "reservation #2" and "OFF" in FIG. 3D indicates that types of "reservation" are not limited to those shown in FIG. 3D. Other examples of the set timing may be "* beats after a readout operation", "* clock pulses after a readout operation", etc. ("*" indicates a desired positive numerical value). Further, for the set timing of the "readout setting", a desired condition that is not based on timing (e.g., measure, beat or clock pulse) measured as the automatic accompaniment progresses may be defined by the user. For example, the condition may be "when the user has performed a predetermined operation, such as a key depression or switch operation, after a readout operation", "* seconds after a readout operation" or the like.

In a case where the switching of the parameter settings shown in FIG. 3A as executed by the conventionally-known electronic music apparatus as set forth above is to be executed by the embodiment of the electronic music apparatus, the user first creates the registration data sets M1 and M2 of FIG. 3C and stores the created registration data sets M1 and M2 into the registration memory prior to a performance. Let it be assumed here that registration data sets M1 and M2 are stored in the registration areas assigned "No. 1" and "No. 2".

When a performance is to be started, the user first depresses the registration readout switch of No. 1. Thus, the registration data set M1 is read out and stored into the current area as noted above. Because the "readout setting" of the registration data set M1 is "normal" for each of the right-hand performance part, left-hand performance part and accompaniment, individual parameter settings included in parameter groups of the right-hand performance part, left-hand performance part and accompaniment are promptly read out and set into corresponding registers. Thus, the right-hand performance part, left-hand performance part and accompaniment are set at "settings a1", "settings b1" and "settings c1", respectively, in the first measure in FIG. 3A.

Then, the user instructs a start of an automatic accompaniment in order to start the performance. Thus, reproduction of automatic accompaniment data selected in aforementioned "settings c1" is started with a tone volume, tempo, etc. set in "settings c1", and the performance is started with the first measure. Although it is assumed that, in the instant embodiment, the start of the automatic accompaniment is instructed by the user depressing a start switch (not shown) belonging to the setting operator unit 2, the start of the automatic accompaniment may be instructed in any other desired manner than depression of the start switch.

As the performance progresses to reach a point immediately before a third beat of the second measure, the user depresses the registration readout switch of "No. 2", so that the registration data set M2 is read out (recalled) and stored into the current area. Because the "readout setting" is "Normal" for the right-hand performance part and "Reservation #1" is for the left-hand performance part and accompaniment, the individual parameter settings included in the parameter group of the right-hand performance part stored in the current area are promptly set into the corresponding registers, while the individual parameter settings included in the parameter groups of the left-hand performance part and the accompaniment are set into the corresponding registers after having waited till the timing indicated by "Reservation #1". More specifically, because a time point when the reproduction of the automatic accompaniment data has progressed to reach a point immediately before a start or end position of the next measure (i.e., start position of the third measure) is the timing indicated by "Reservation #1", the individual parameter settings included in the parameter groups of the left-hand performance part and the accompaniment are set into the corresponding registers at that timing.

Consequently, the parameter settings for the right-hand performance part, right-hand performance part and accompaniment switch to "settings a2", "setting b1" and "settings c1" at the third beat of the second measure and then switch to "settings a2", "setting b2" and "settings c2" at the beginning of the third measure. More specifically, at the third beat of the second measure, only the parameter settings for the right-hand performance part switch from "settings a1" to "settings a2", while the parameter settings for the left-hand performance part and accompaniment are maintained at, i.e. left unchanged from, the last settings, i.e. "settings b1" and "settings c1". Then, at the beginning of the third measure, the parameter settings for the right-hand performance part are maintained at the last settings, "settings a2", while the parameter settings for the left-hand performance part and accompaniment switch from "settings b1" and "settings c1" to "settings b2" and "settings c2".

As seen from the foregoing, the embodiment of the electronic music apparatus can perform setting switching processing similar to that performed by the conventionally-known electronic music apparatus while effectively reducing or minimizing user's time and labor necessary for registration creation work, necessary memory capacity and the number of user's readout operations.

The following describe the control processing in greater detail.

FIG. 4 is a flow chart showing an example operational sequence of registration data readout (recall) setting processing performed by the embodiment of the electronic music apparatus, particularly by the CPU 5 of the electronic musical apparatus. This registration data readout setting processing is started up in response to user's depression of any one of the registration readout switches.

Upon startup of the registration data readout setting processing, the CPU 5 reads out (recalls) the registration data set designated by the depressed registration readout switch from the corresponding registration area of the registration memory and stores the read-out registration data set into the current area, at step S1.

Then, at step S2, the CPU 5 checks each of the "readout settings" included in the registration data set stored in the current area (such a readout setting is included for each of the right-hand performance part, left-hand performance part and accompaniment), to determine whether, in the registration data set stored in the current area, there is any parameter group having "Normal" set as the readout setting therefor. If there is any parameter group having "Normal" set as the readout setting therefor as determined at step S2, the CPU 5 promptly sets the individual parameter settings, included in the parameter group having "Normal" set as the readout setting therefor, into the corresponding registers at step S3.

If the registration data set M1 is currently stored in the current area, the individual parameter settings included in the parameter groups of the right-hand performance part, left-hand performance part and accompaniment are promptly set into the corresponding registers because "Normal" is set as the "readout setting" for the right-hand performance part, left-hand performance part and accompaniment. Thus, the right-hand performance part, left-hand performance part and accompaniment are set at "settings a1", "settings b1" and "settings c1", respectively, in the first measure in FIG. 3A. If the registration data set M2 is currently stored in the current area, only the individual parameter settings included in the parameter group of the right-hand performance part are promptly set into the corresponding registers because "Normal" is set as the "readout setting" only for the right-hand performance part. Thus, the parameter settings for the right-hand performance part switch to "settings a2" at the third beat of the second measure of FIG. 3A. The parameter settings for the left-hand performance part and accompaniment are left unchanged from "settings b1" and "settings c1".

If there is no parameter group having "Normal" set as the readout setting therefor as determined at step S2, the CPU 5 skips step S3 to go to step S4.

Then, at step S4, the CPU 5 checks each of the "readout settings" included in the registration data set stored in the current area, to determine whether, in the stored registration data set, there is any parameter group having "Reservation" set as the readout setting therefor. If there is any parameter group having "Reservation" set as the readout setting therefor, the CPU 5 sets timing for setting the individual parameter settings included in that parameter group into the corresponding register, at step S5. In the instant embodiment, the number of clock pulses from the start time of the performance of the music piece (i.e., clock pulses generated by the clock used for reproduction of automatic accompaniment data) is used as the "set timing", because the "set timing" is detected in interrupt processing (later described in relation to FIG. 5) that is started up per clock pulse. In the instant embodiment, the number of clock pulses from the start time of the performance is used as the "set timing" just for convenience sake, and other suitable timing information than the number of clock pulses, such as time of day or absolute time from a predetermined reference time point, may be used as the "set timing" information. Namely, any suitable time information may be used as the "set timing" information. Further, in the case where the number of clock pulses is used as the "set timing", the number of clock pulses from the beginning of each measure or each beat or the like, rather than from the start time of the performance, may be used as the "set timing" as long as it can be properly defined as the "set timing".

If the registration data set M2 is currently stored in the current area, the CPU 5 calculates, for the left-hand performance part and the accompaniment, the number of clock pulses indicative of the beginning of a measure immediately following a readout operation and stores (sets) the calculated number of clock pulses as the "set timing" into a set timing storage area (not shown) provided in the RAM 7, because "Reservation #1" is set in the registration data set M2 as the "readout setting" for the left-hand performance part and the accompaniment. In this case, the thus-calculated "set timing" is stored into the set timing storage area in such a way that the set timing for the left-hand performance part and the set timing for the accompaniment can be distinguished from each other.

If there is no parameter group having "Reservation" set as the readout setting therefor as determined at step S4, the CPU 5 brings the instant registration data readout setting processing to an end.

FIG. 5 is a flow chart showing an example operational sequence of the interrupt processing. This interrupt processing is started up in response to a rising edge (or falling edge) of a clock pulse. For generation of clock pulses, the CPU 5 sets a cyclic period corresponding to a tempo (which corresponds to a "tempo" included in the accompaniment-related parameters of FIG. 2) and instructs the timer 13 to generate clock pulses. Further, a counter (not shown) for counting the number of clock pulses is provided for the timer 13, and the counter can be reset by the CPU 5. Namely, while clock pulses are being generated, the counter continues to count the number of clock pulses from a time when it is reset to a current time.

Upon startup of the interrupt processing, the CPU 5 compares a count of the counter and the "set timing" stored in the set timing storage area and determines whether there is any parameter group for which the count value of the counter (i.e. current time) and the "set timing" has coincided with each other, i.e. for which the current time has reached the reserved "set timing", at step S11. Namely, if any one of the parameter groups whose readout setting is "Reservation" has been determined, on the basis of the count value, to have arrived at the "set timing", the CPU 5 sets individual parameter settings included in that parameter group into the corresponding registers, at step S12.

In the case where the registration data set M2 is currently stored in the current area, "Reservation #1" is set as the "readout setting" for each of the left-hand performance part and the accompaniment. Because the operation for reading out the registration data set M2 was performed by the user at a point immediately before the third beat of the second measure (see FIG. 3A), the number of clock pulses corresponding to the position of the "beginning of the third measure" is stored in the set timing storage area as the "set timing" for the left-hand performance part and the accompaniment. Thus, once the performance progresses to reach the position of the "beginning of the third measure", the individual parameter settings included in each of the parameter groups of the left-hand performance part and the accompaniment are set into the corresponding registers. Thus, the parameter settings for the left-hand performance part and accompaniment are switched to "settings b2" and "setting c2" while the parameter settings for the right-hand performance part are left unchanged from "settings a2".

If, on the other hand, there is no parameter group for which the count value of the counter (i.e. current time) and the "set timing" has coincided with each other as determined at step S11, the CPU 5 skips step S12 to go to step S13. Here, the determination that "there is no parameter group for which the count value of the counter (i.e. current time) and the "set timing" has coincided with each other" is made: if there is no parameter group whose "readout setting" is "Reservation"; no "set timing" is currently stored in the set timing storage area (see the registration data M1 of FIG. 3C); or if, although "set timing" is currently stored in the set timing storage area, the set timing has not yet been reached or has already passed.

At next step S13, the CPU 5 performs a reproduction process on automatic accompaniment data corresponding to the clock pulses. The automatic accompaniment data may be any type of data, such as song data, rhythm pattern data, accompaniment style data or arpeggio data. Alternatively, "performance" data may be used in place of the "accompaniment" data. Further, the automatic accompaniment data or performance data may be of any data format Although content of the reproduction process differs depending on the format of the automatic accompaniment data or performance data, it can be implemented easily using a well-known scheme and thus will not be described here.

Upon completion of the operation of step S13, the CPU 5 brings the interrupt processing to an end.

Figures 6A, 6B:
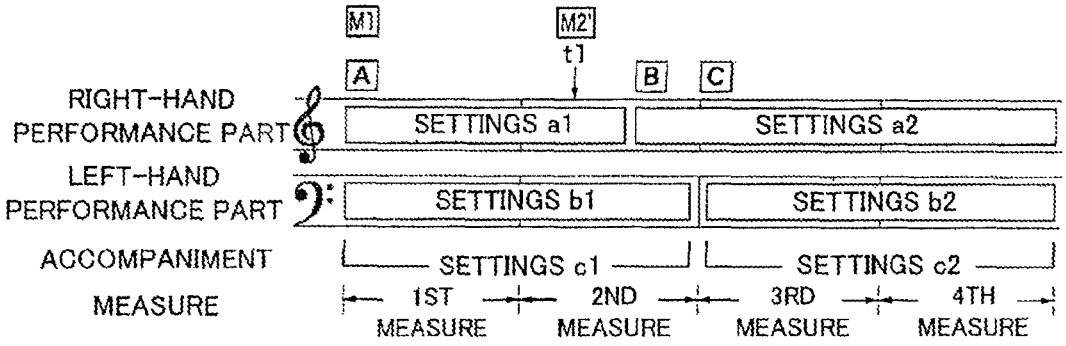
FIGS. 6A and 6B are diagrams showing other example settings made by registration data sets.

FIG. 6 is a diagram showing other example settings made by registration data sets, which particularly shows cases where switching of parameter settings similar to that shown in FIG. 3A is executed at readout (recall) operation timing different from that shown in FIG. 3A.

In FIG. 3A, the readout operation for reading out (recalling) the registration data set M2 is performed at timing when the parameter settings for the right-hand performance part are to be switched from settings a1 to settings a2, as noted above. By contrast, in FIG. 6A, a readout operation for reading out (recalling) a registration data set M2' is performed at a time point t1 earlier than the timing when the parameter settings for the right-hand performance part are to be switched from settings a1 to settings a2.

Because the readout operation for the registration data set M2' is performed during continuation (use) of settings a1 (more specifically, at a final phase of settings a1) for the right-hand performance part, the "readout setting" for the right-hand performance part is set at "Reservation #2" in the registration data set M2', unlike in the registration data set M2. "Reservation #2" means "set at a beat immediately following the readout operation" as noted above.

If such a registration data set M2' is created and stored in advance, it is possible to eliminate a need for the user to perform the readout operation for the registration data set M2' by accurately choosing the right timing for switching the parameter settings for the right-hand performance part from settings a1 to settings a2, and thus, user's operability can be significantly enhanced.

Whereas the preferred embodiment has been described above in relation to the case where an instruction for reading out a registration data set is given by the user operating a corresponding one of the registration readout switches, the operators to be used for this purpose is not limited to the aforementioned registration readout switches and may be operators of another type, such as a foot switch. Alternatively, readout instructing data may be embedded in automatic accompaniment data, instead of the user giving a readout instruction, so that a readout instruction is automatically given in response to the readout instructing data being read out or reproduced during reproduction of the automatic accompaniment data. As another alternative, arrangements may be made such that readout instructing data transmitted from external equipment can be received via the communication I/O 10 so that a readout instruction is given in response to the readout instructing data being received from the external equipment via the communication I/O 10.

Further, whereas the preferred embodiment has been described above in relation to the case where the "readout settings" are included in the registration data sets, the present invention is not so limited, and the readout settings may be stored in another storage area, different from the storage areas for the registration data sets, in association with the individual registration data sets so that, in response to an instruction for reading out a desired one of the registration data sets, the "readout setting" corresponding to the desired registration data set is referenced.

Furthermore, whereas the preferred embodiment has been described above in relation to the case where one "readout setting" is set for each of parameter groups (i.e., parameter groups of the right-hand performance part, left-hand performance part and accompaniment) each comprising a plurality of parameters, the present invention is not so limited, and such a "readout setting" may be set separately for each of the parameters in each of the registration data sets.

Furthermore, whereas the preferred embodiment has been described above in relation to the case where, in response to an instruction for reading out a registration data set, the registration data set is temporarily stored into the current area of the RAM 7 and then parameters included in the registration data set are set into the corresponding registers in response to the "readout setting", the present invention is not so limited, and the parameters included in the registration data set may be directly set into the corresponding registers in accordance with the "readout setting" without being temporarily stored into the current area.

Furthermore, registration data to which the delayed readout technique is applicable may comprise a plurality of effect setting parameters or other tone-signal processing setting parameters in place of or in addition to a plurality of tone color setting parameters and a plurality of accompaniment setting parameters. For example, the present invention is applicable to scene data of an audio mixer, in which case the audio mixer corresponds to the electronic music apparatus of the present invention.

Needless to say, the objects of the present invention can be accomplished by supplying a system or apparatus with a storage medium having stored therein program codes of software implementing the functions of the above-described embodiment so that a computer (CPU or MPU) of the system or apparatus reads out and executes the program codes stored in the storage medium. In such a case, the program codes read out from the storage medium themselves implement the novel functions of the present invention, and these program codes and the storage medium having stored therein the program codes together implement the present invention.

Furthermore, the storage medium for supplying the program codes may be, for example, a flexible disk, hard disk, magneto-optical disk, CD-ROM, CD-R, CD-RW, DVD-ROM, DVD-RAM, DVD-RW, DVD+RW, magnetic tape, non-volatile memory card, ROM or the like. As an alternative, the program codes may be supplied from a server computer via a communication network.

Moreover, whereas the functions of the above-described embodiment of the invention have been described above as implemented by a computer reading out and executing the program codes, they may of course be implemented by an OS and the like, running on the computer, performing a part or whole of the actual processing on the basis of the instructions of the program codes.

Further, needless to say, the program codes, read out from the storage medium, may be written into a memory provided on a function extension board inserted in the computer or on a function extension unit connected to the computer so that the functions of the above-described embodiment can be implemented by a CPU and the like, provided in the function extension board or the function extension unit, performing a part or whole of the actual processing on the basis of the instructions of the program codes.

This application is based on, and claims priority to, JP PA 2012-249268 filed on 13 Nov. 2012. The disclosure of the priority application, in its entirety, including the drawings, claims, and the specification thereof, are incorporated herein by reference.

What is claimed is:

1. An electronic music apparatus comprising:

a storage section storing a plurality of sets of registration data, a first set of registration data of the plurality of sets of registration data comprising a plurality of tone setting parameters, wherein:

at least a first tone setting parameter of the plurality of tone setting parameters is associated with first readout timing data, at least a second tone setting parameter of the plurality of tone setting parameters is associated with second readout timing data, and the first set of registration data is used for setting a plurality of parameters of an electronic musical instrument;

an instruction section configured to instruct readout of the first set of registration data from said storage section; and a control section, in response to an instruction issued by said instruction section at a first time for reading out the first set of registration data:

setting, at a first readout timing, at least a first parameter of the plurality of parameters of the electronic musical instrument based on at least the first tone setting parameter associated with the first readout timing data, and setting, at a second readout timing, later than the first readout timing, at least a second parameter of the plurality of parameters of the electronic musical instrument based on at least the second tone setting parameter associated with the second readout timing data, wherein the second readout timing is based on the second readout timing data.

2. The electronic music apparatus as claimed in claim 1, wherein:

the plurality of tone setting parameters in the first set of registration data are classified into a plurality of sub-sets, one sub-set including the first tone setting parameter, and another sub-set including the second tone setting parameter, a respective delayed readout timing is pre-defined for each of the sub-sets, and at least one of the respective delayed readout timings comprises the second readout timing.

3. The electronic music apparatus as claimed in claim 2, wherein delayed readout timing data, including the second readout timing data, indicative of the delayed readout timing predefined for each of the sub-sets is stored in said storage section in association with the first set of registration data.

4. The electronic music apparatus as claimed in claim 3, wherein the delayed readout timing data indicative of the delayed readout timing and stored in said storage section is editable.

5. The electronic music apparatus as claimed in claim 1, wherein the second readout timing is timing selected from among a plurality of different readout timings.

6. The electronic music apparatus as claimed in claim 1, wherein the registration data are used in a music performance.

7. The electronic music apparatus as claimed in claim 1, wherein the first set of registration data comprises any one of sets of sound color setting parameters, accompaniment setting parameters, effect setting parameters and sound-signal processing setting parameters.

8. The electronic music apparatus as claimed in claim 1, further comprising an automatic performance section configured to execute an automatic performance of a music piece, wherein the second readout timing is synchronized with a progression of the automatic performance executed by said automatic performance section.

9. The electronic music apparatus as claimed in claim 1, wherein said instruction section instructs readout of the first set of registration data in response to a user's operation.

10. A computer-implemented method for reading out registration data from a storage section, the storage section storing a plurality of sets of registration data, a first set of registration data of the plurality of sets of registration data comprising a plurality of tone setting parameters, wherein:

at least a first tone setting parameter of the plurality of tone setting parameters is associated with first readout timing data, at least a second tone setting parameter of the plurality of tone setting parameters is associated with second readout timing data, and the first set of registration data is used for setting a plurality of parameters of an electronic musical instrument, said method comprising:

an instruction step of instructing readout of the first set of registration data from the storage section; and a control step of, in response to an instruction issued by said instruction step at a first time for reading out the first set of registration data;

setting, at a first readout timing, at least a first parameter of the plurality of parameters of the electronic musical instrument based on at least the first tone setting parameter associated with the first readout timing data, and setting, at a second readout timing, later than the first readout timing, at least a second parameter of the plurality of parameters of the electronic musical instrument based on at least the second tone setting parameter associated with the second readout timing data, wherein the second readout timing is based on the second readout timing data.

11. A non-transitory computer-readable storage medium storing a program executable by a processor for implementing a method for reading out registration data from a storage section, the storage section storing a plurality of sets of registration data, a first set of registration data of the plurality of sets of registration data comprising a plurality of tone setting parameters, wherein:

at least a first tone setting parameter of the plurality of tone setting parameters is associated with first readout timing data, at least a second tone setting parameter of the plurality of tone setting parameters is associated with second readout timing data, and the first set of registration data is used for setting a plurality of parameters of an electronic musical instrument, said method comprising:

an instruction step of instructing readout of the first set of registration data from the storage section; and a control step of, in response to an instruction issued by said instruction step at a first time for reading out the first set of registration data:

setting, at a first readout timing, at least a first parameter of the plurality of parameters of the electronic musical instrument based on at least the first tone setting parameter associated with the first readout timing data, and setting, at a second readout timing, later than the first readout timing, at least a second parameter of the plurality of parameters of the electronic musical instrument based on at least the second tone setting parameter associated with the second readout timing data, wherein the second readout timing is based on the second readout timing data.

12. A storage device comprising:

a first storage section storing a plurality of sets of registration data each comprising a plurality of tone setting parameters including:

at least a respective first tone setting parameter associated with a respective first readout timing data, and at least a respective second tone setting parameter associated with a respective second readout timing data, wherein any one of the sets of registration data is capable of being read out from said first storage section in response to a readout instruction, and any one of the sets of registration data is capable of being used for setting a plurality of parameters of an electronic musical instrument; and a second storage section storing the respective first and second readout timing data in association with respective ones of the sets of registration data, the respective first readout timing data defining respective first readout timings and the respective second readout timing data defining respective second readout timings such that, in response to an instruction for reading out a respective one of the sets of registration data at a first time:

at a respective first readout timing, at least a first parameter of the plurality of parameters of the electronic musical instrument is set based on at least the respective first tone setting parameter associated with the respective first readout timing data, and at a respective second readout timing, later than the respective first readout timing, at least a second parameter of the plurality of parameters of the electronic musical instrument is set based on at least the respective second tone setting parameter associated with the respective second readout timing data, wherein the respective second readout timing is based on the respective second readout timing data.

13. The storage device as claimed in claim 12, wherein the registration data are used in a music performance.

14. The storage device as claimed in claim 12, wherein:

the plurality of tone setting parameters in each of the sets of registration data are classified into a plurality of sub-sets, a respective one of the sub-sets including the respective first tone setting parameter, and a respective other of the sub-sets including the respective second tone setting parameter, the respective second readout timings are pre-defined for each of the sub-sets, and the respective second readout timing data defining the respective second readout timings predefined for each of the sub-sets is stored in said second storage section in association with respective ones of the sets of registration data.

* * * * *